US007117944B2

(12) United States Patent
Boyadjieff

(10) Patent No.: US 7,117,944 B2
(45) **Date of Patent: *Oct. 10, 2006**

(54) DRILL PIPE HAVING AN INTERNALLY COATED ELECTRICAL PATHWAY

(75) Inventor: George Boyadjieff, Villa Park, CA (US)

(73) Assignee: Varco I/P, Inc., Orange, CA (US)

( * ) Notice: Subject to any disclaimer, the term of this patent is extended or adjusted under 35 U.S.C. 154(b) by 57 days.

This patent is subject to a terminal disclaimer.

(21) Appl. No.: 10/812,287

(22) Filed: Mar. 29, 2004

(65) Prior Publication Data

US 2004/0177956 A1 Sep. 16, 2004

Related U.S. Application Data

(63) Continuation of application No. 10/279,717, filed on Oct. 23, 2002, now Pat. No. 6,763,887.

(51) Int. Cl.
*E21B 36/00* (2006.01)

(52) U.S. Cl. ..... 166/302; 166/57; 166/65.1; 175/320

(58) Field of Classification Search ..... 166/57, 166/65.1, 242.6, 302; 175/104, 320, 321
See application file for complete search history.

(56) References Cited

U.S. PATENT DOCUMENTS

| | | | | |
|---|---|---|---|---|
| 2,000,716 | A | 5/1935 | Polk | |
| 3,518,608 | A | 6/1970 | Papadopoulos | |
| 3,857,776 | A | 12/1974 | Titus et al. | |
| 3,866,678 | A | 2/1975 | Jeter | |
| 3,879,097 | A | 4/1975 | Oertle | |
| 4,012,092 | A | 3/1977 | Godbey | |
| 4,051,456 | A | 9/1977 | Heilhecker et al. | |
| 4,120,325 | A | 10/1978 | de Putter | |
| 4,121,193 | A | 10/1978 | Denison | |
| 4,286,217 | A | 8/1981 | Planche et al. | |
| 4,445,734 | A | 5/1984 | Cunningham | |
| 4,483,393 | A | 11/1984 | More et al. | |
| 4,484,627 | A | 11/1984 | Perkins | |
| 4,496,203 | A | 1/1985 | Meadows | |
| 4,584,675 | A * | 4/1986 | Peppers | 367/81 |
| 4,690,212 | A | 9/1987 | Termohlen | |
| 4,730,234 | A | 3/1988 | Monico, Jr. | |
| 4,821,035 | A | 4/1989 | Hanson et al. | |
| 4,953,636 | A | 9/1990 | Mohn | |
| 5,060,737 | A | 10/1991 | Mohn | |
| 5,219,298 | A | 6/1993 | Morin et al. | |
| 6,223,826 | B1 | 5/2001 | Chau et al. | |
| 6,332,499 | B1 | 12/2001 | Kobylinski et al. | |
| 6,367,564 | B1 | 4/2002 | Mills et al. | |
| 6,515,592 | B1 * | 2/2003 | Babour et al. | |
| 2002/0014334 | A1 | 2/2002 | Chau et al. | |

FOREIGN PATENT DOCUMENTS

| | | |
|---|---|---|
| GB | 2 110 270 | * 11/1981 |

* cited by examiner

*Primary Examiner*—Zakiya W. Bates
(74) *Attorney, Agent, or Firm*—Christie, Parker & Hale, LLP

(57) ABSTRACT

A drill pipe for an oil or gas well is provided that includes a generally cylindrical hollow drill pipe having a length; and a conductive coating connected to the drill pipe to define an electrical pathway that extends along at least a portion of the length of the drill pipe.

23 Claims, 6 Drawing Sheets

DRILL PIPE HAVING AN INTERNALLY COATED ELECTRICAL PATHWAY

CROSS-REFERENCE TO RELATED APPLICATION(S)

This application is a continuation of U.S. patent application Ser. No. 10/279,717 entitled "Drill Pipe Having an Internally Coated Electrical Pathway," filed Oct. 23, 2002 now U.S. Pat. No. 6,763,887, the entire content of which is incorporated by reference herein.

FIELD OF THE INVENTION

The present invention relates generally to a drill pipe for an oil or gas well and more particularly to a drill pipe having an internally coated conductive material for providing an electrical pathway for electronic data obtained down hole to be efficiently transmitted to the surface of an oil or gas well.

BACKGROUND OF THE INVENTION

Currently there exist tools in the oil and gas well industry that are specifically designed to obtain drilling and geological parameters downhole, near the drill bit. In some instances, the information obtained by these tools is stored in memory devices. In such cases, the stored information can be retrieved when the memory devices are returned to the surface of the well. This system, however, produces an undesirable lag time between the initial collection and storing of the downhole information and the retrieval of the downhole information at the surface of the well.

As an alternative, the downhole information can be transmitted to the surface of the well using pressure pulses in the drilling fluid. However, this method also produces an undesirable lag time caused by the time a pressure pulse takes to reach the surface. Accordingly, a need exists for a method and a system of transmitting data instantaneously and efficiently to the surface of a well.

SUMMARY OF THE INVENTION

In one embodiment, the present invention is a drill pipe for an oil or gas well that includes a generally cylindrical hollow drill pipe having a length; and a conductive coating connected to the drill pipe to define an electrical pathway that extends along at least a portion of the length of the drill pipe.

In another embodiment, the present invention is a method of communicating to downhole oil or gas well equipment that includes providing a generally cylindrical hollow drill pipe having a length; and applying a conductive coating on the drill pipe to define an electrical pathway that extends along at least a portion of the length of the drill pipe.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

As shown in FIGS. 1–6, the present invention is directed a drill pipe having an internally coated conductive material for forming an electrical pathway from an upper end of the drill pipe to a lower end of the drill pipe. The drill pipe of the current invention allows for communication between a well head and downhole equipment in an oil or gas well so that drilling parameters and geological parameters may be obtained downhole and transmitted to the well head for analysis.

Figure 1:
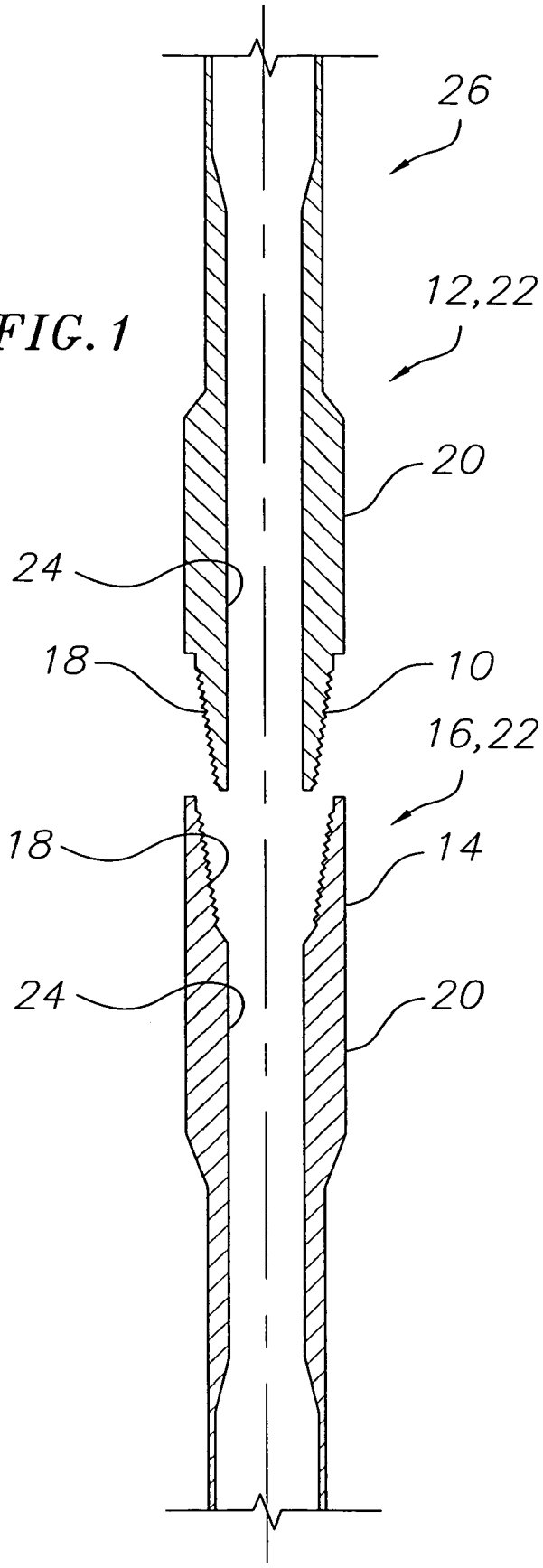
FIG. 1 is a cross-sectional view of a lower end of a first drill pipe and a cross-sectional view of an upper end of a second drill pipe.

FIG. 1 shows a lower end 10 of a first drill pipe 12 and an upper end 14 of a second drill pipe 16. Although omitted for clarity, the first drill pipe 12 comprises an upper end that is similar to the upper end 14 of a second drill pipe 16 and the second drill pipe 16 comprises a lower end that is similar to the lower end 10 of the first drill pipe 12. As such, reference to the lower end 10 and the upper end 14 in the following description is to be understood to apply equally to the first drill pipe 12 and to the second drill pipe 16. In addition, the first drill pipe 12 and the second drill pipe 16 are shaped and formed similarly, such that reference to a drill pipe 22 in the following description is to be understood to apply equally to the first drill pipe 12 and to the second drill pipe 16.

As depicted in FIG. 1, the drill pipe 22 comprises a body portion 20 that is generally cylindrical in shape and has a hollow center defined by an inner diameter 24. The upper and lower ends 10 and 14 of the drill pipe 22 each comprise threads 18. The threads 18 allow the upper end 10 of one drill pipe 22 to be connected to the lower end 14 of another drill pipe 22. Drill pipes 22 that are connected in this way (as is shown in FIGS. 2–3 and 5–6) are typically collectively referred to as a drill string 26. Although FIGS. 2–3 and 5–6 show the drill string 26 as having only two drill pipes 22, the drill string may comprise any number of connected drill pipes 22.

In an exemplary embodiment, the threads 18 are special tapered threads that, when engaged, provide a connection that is almost as strong as the body portion 20 of the drill pipe 22 and also provides a very reliable pressure seal for drilling fluids that are pumped through the drill string 26 during the drilling process.

Figure 2:
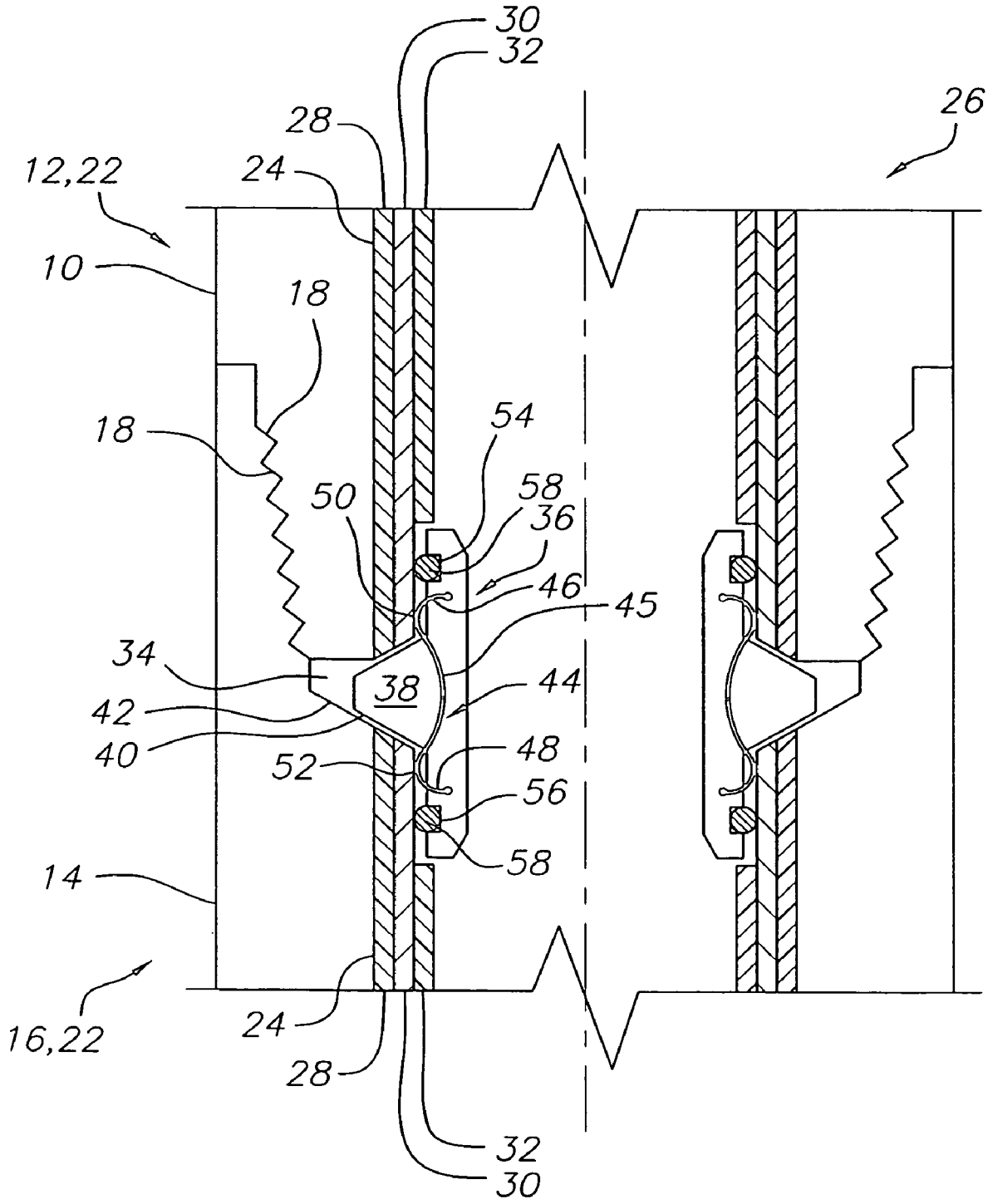
FIG. 2 is a cross-sectional view of the drill pipes of FIG. 1 threadingly connected, wherein each drill pipe has a conductive coating electrically connected by a connector.

In one embodiment, as depicted in FIG. 2, each drill pipe 22 in the drill string 26 comprises an outer insulative coating 28 attached to the inner diameter 24 of the drill pipe 22, a conductive coating 30 attached to the outer insulative coating 28, and an inner insulative coating 32 attached to the conductive coating 30. As such, the outer insulative coating 28, the conductive coating 30 and the inner insulative coating 32 of each drill pipe 22 together form an insulated electrical pathway from the upper end 14 of the drill pipe 22 to the lower end 10 of the drill pipe 22, i.e. the outer insulative coating 28 insulates the conductive coating 30 from the body 20 of the drill pipe 22, which is typically comprised of a metal material, and the inner insulative coating 32 insulates the conductive coating 30 from the drilling fluids.

As shown in FIGS. 2–3 and 5–6 when two drill pipes 22 are connected, a small gap 34 exists between the lower end 10 of one drill pipe 22 and the upper end 14 of the adjacent drill pipe 22. In one embodiment, a connector 36 is attached to the drill string 26 in the small gap 34 between adjacent drill pipes 22 to electrically connect the insulated electrically pathways of the adjacent drill pipes 22. For example, in the depicted embodiment of FIG. 2, the connector 36 comprises a protruding section 38 that has a larger diameter than the inner diameter 24 of the drill pipes 22, such that when the connector 36 is disposed between the lower end 10 of one drill pipe 22 and the upper end 14 of the adjacent drill pipe 22 and the drill pipes 22 are connected, the connector 36 is trapped in the small gap 34 between the drill pipes 22.

In one embodiment, the protruding section 38 of the connector 36 comprises a protruding shoulder 40 that mates with or abuts against a shoulder 42 in the upper end 14 of the drill pipe 22 to secure the connector to the drill string 26 when the connector 36 is disposed between the lower end 10 of one drill pipe 22 and the upper end 14 of the adjacent drill pipe 22.

To establish the electrical connection between the insulated electrically pathways of the adjacently connected drill pipes 22, the connector 36 comprises a conducting material 44 that has a body portion 45, an upper conducting contact 46 and a lower conducting contact 48. When the connector 36 is disposed between the lower end 10 of one drill pipe 22 and the upper end 14 of the adjacent drill pipe 22, the upper conducting contact 46 establishes an electrical connection 50 with the conductive coating 30 in the lower end 10 of one drill pipe 22 and the lower conducting contact 48 establishes an electrical connection 52 with the conductive coating 30 in the upper end 14 of the adjacent drill pipe 22. As such, an electrical pathway is established from the conductive coating 30 in the lower end 10 of one drill pipe 22, to the upper conducting contact 46, then to the connector conducting material body portion 45, then to the lower conducting contact 48, and then to the upper end 14 of the adjacent drill pipe 22.

In one embodiment, the connector 36 is comprised of an insulative material, such that the electrical pathway from the upper conducting contact 46, to the conducing material body portion 45, to the lower conducting contact 48, is insulated. For instance, the connector 36 may be formed in a molding process, such as injection molding, with the conducting material 44 being molded into the insulative material of the connector 36. In one embodiment, the conducting material 44 is elastic, such that the upper conducting contact 46 and the lower conducting contact 48 compress when the electrical connections 50 and 52 are established between the adjacent drill pipes 22.

The connector 36 may also comprise an upper annular groove 54 and a lower annular groove 56. For instance, in the embodiment depicted in FIG. 2, the upper annular groove 54 is disposed above the upper conducting contact 46, and hence above the electrical connection 50, while the lower annular groove 56 is disposed below the lower conducting contact 48, and hence below the electrical connection 52. Disposed within each annular groove 54 and 56 is an elastomeric o-ring 58. The o-ring 58 in the upper annular groove 54 creates a seal against the conductive coating 30 in the lower end 10 of one drill pipe 22 to prevent the drilling fluids from contaminating the electrical connections 50 and 52 from above, while the o-ring 58 in the lower annular groove 56 creates a seal against the conductive coating 30 in the upper end 14 of the adjacent drill pipe 22 to prevent the drilling fluids from contaminating the electrical connections 50 and 52 from below.

Figure 4A:
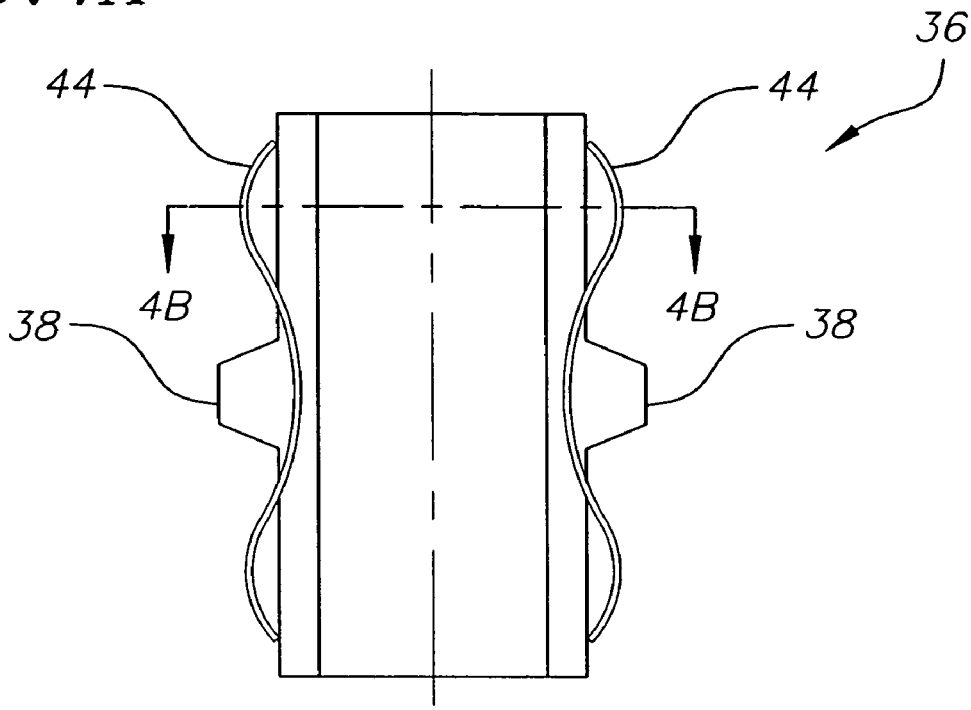
FIG. 4A is a longitudinal cross-section of the connector of FIG. 2.
Figure 4B:
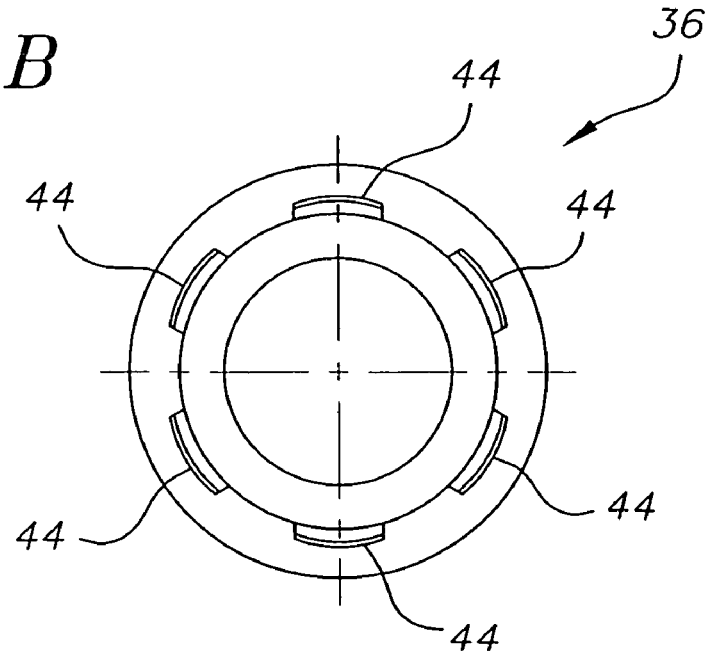
FIG. 4B is a transverse cross-section of the connector of FIG. 2, taken from line 4B—4B of FIG. 4A.

The connector 36 may comprise one conducting material 44, or, as depicted in FIGS. 4A and 4B, the connector 36 may comprise a plurality of conducting materials 44. For instance, in the depicted embodiment of FIGS. 4A and 4B, the connector 36 comprises six conducting materials 44, each attached to the connector 36 and forming the electrical connections 50 and 52 as described above.

The drill string 26 may comprise a plurality of adjacently connected drill pipes 22, wherein each adjacently connected drill pipe 22 has a the connector 36 disposed therebetween as described above, such that each connector 36 electrically connects the conductive coating 30 of one drill pipe 22 to the conductive coating 30 of its adjacent drill pipe 22 to establish an insulated electrical pathway from an upper end of the drill string 26 to a lower end of the drill string 26.

Figure 3:
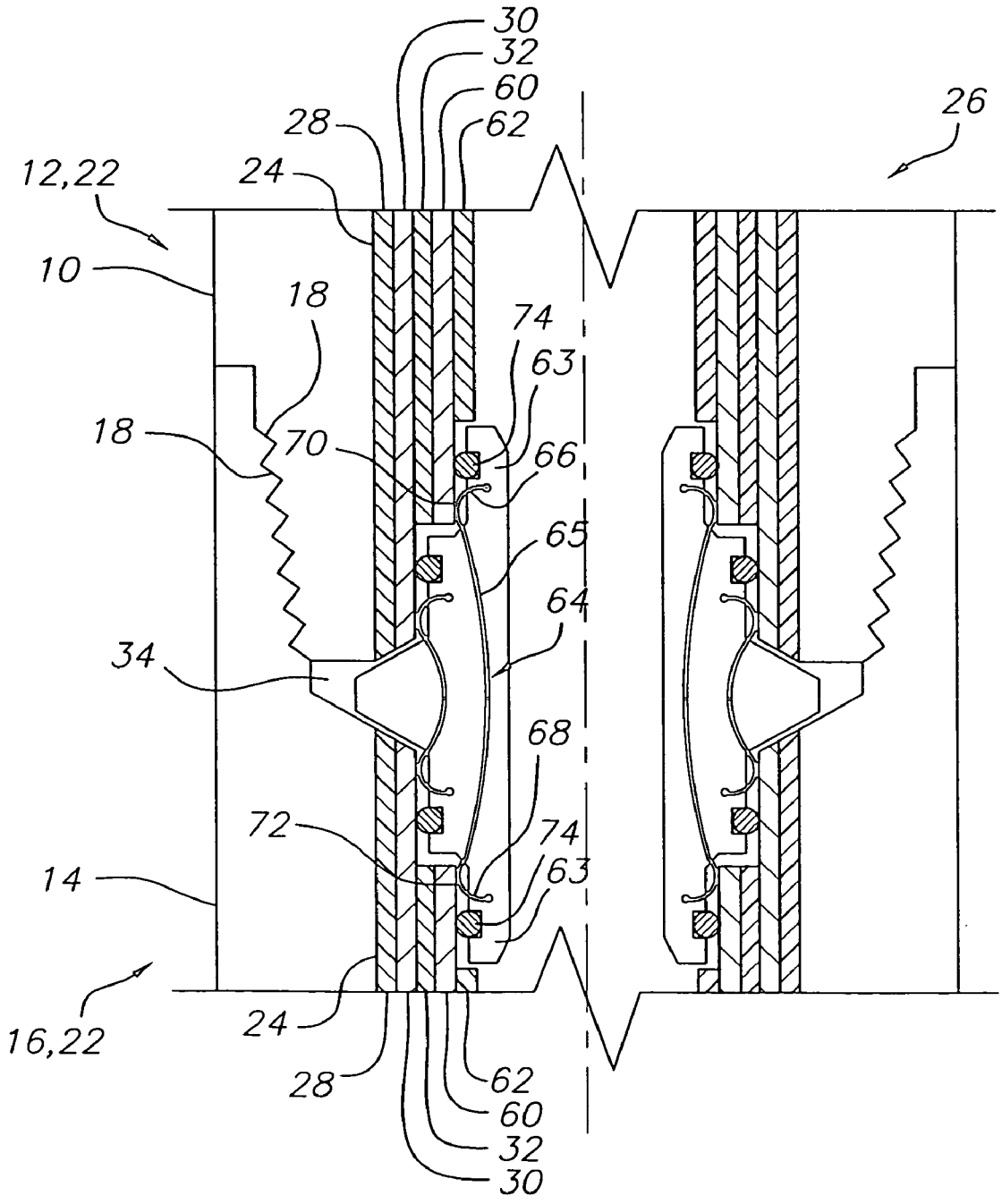
FIG. 3 is a cross-sectional view of the drill pipes of FIG. 1 threadingly connected, wherein each drill pipe has a first conductive coating and a second conductive coating, and wherein the corresponding first conductive coatings and the corresponding second conductive coatings are electrically connected by a connector.

As depicted in FIG. 3, each drill pipe 22 in the drill string 26 may comprise a second conductive coating 60 attached to the inner insulative coating 32, and a second inner insulative coating 62 attached to the second conductive coating 60, such that the inner insulative coating 32, the second conductive coating 60 and the second inner insulative coating 62 together form a second insulated electrical pathway.

In such an embodiment, the connector 36 may have an inwardly stepped section 63, containing a second conducting material 64 having a body portion 65, an upper conducting contact 66 and a lower conducting contact 68. The second conducting material 64 may be formed and attached to the conductor 36 as described above with respect to the conducting material 44.

When the connector 36 is disposed between the lower end 10 of one drill pipe 22 and the upper end 14 of the adjacent drill pipe 22, the upper conducting contact 66 establishes an electrical connection 70 with the conductive coating 60 in the lower end 10 of one drill pipe 22 and the lower conducting contact 68 establishes an electrical connection 72 with the conductive coating 60 in the upper end 14 of the adjacent drill pipe 22. As such, an electrical pathway is established from the conductive coating 60 in the lower end 10 of one drill pipe 22, to the upper conducting contact 66, then to the connector conducting material body portion 65, then to the lower conducting contact 68, and then to the upper end 14 of the adjacent drill pipe 22. As described above and as shown in FIGS. 4A and 4B, the connector 36 may comprise one second conducting material 64, or the connector 36 may comprise a plurality of second conducting materials 64.

The drill string 26 may comprise a plurality of adjacently connected drill pipes 22, wherein each adjacently connected drill pipe 22 has the connector 36 disposed therebetween as described above, such that each connector 36 electrically connects the conductive coating 60 of one drill pipe 22 to the conductive coating 60 of its adjacent drill pipe 22 to establish a second insulated electrical pathway from an upper end of the drill string 26 to a lower end of the drill string 26. O-rings may be used, as described above, to prevent the drilling fluids from contaminating the electrical connections 70 and 72.

Each drill pipe 22 in the drill string 26 may comprise a plurality of conductive coatings and each connector may comprise a corresponding plurality of inwardly stepped sections and conducting materials, such that the drill string 26 comprises a plurality of insulated electrical pathways from an upper end of the drill string 26 to a lower end of the drill string 26.

Figure 5:
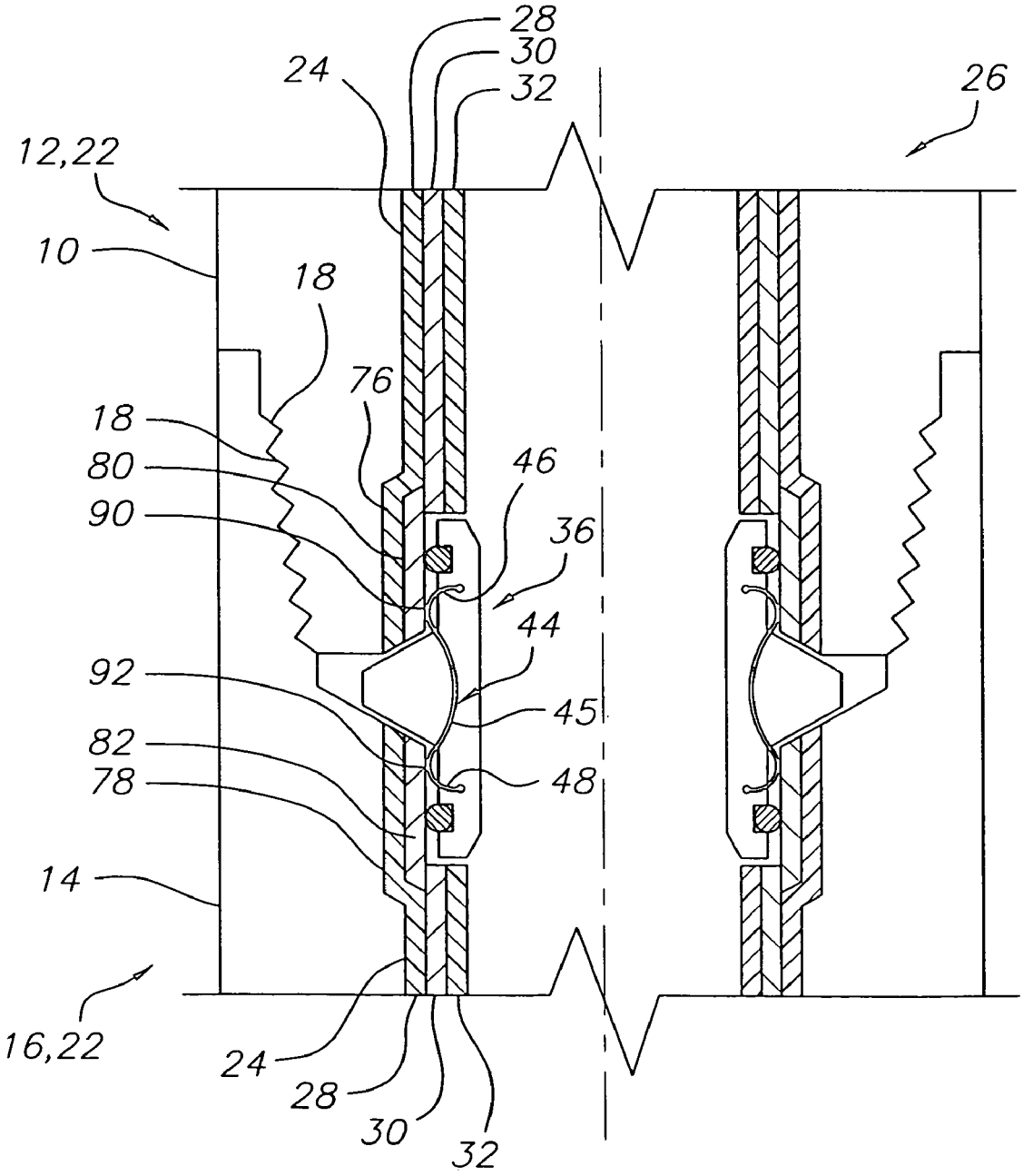
FIG. 5 is a cross-sectional view of the drill pipes of FIG. 1 threadingly connected, wherein each drill pipe has a conductive coating electrically connected to an upper and a lower conductive sleeve and wherein a lower conductive sleeve of the first drill pipe is connected to the upper conductive sleeve of the second drill pipe by the connector of FIGS. 4A and 4B.

In one embodiment, as depicted in FIG. 5, the lower end 10 and the upper end 14 of each drill pipe 22 in the drill string 26 comprises a lower annular recess 76 and an upper annular recess 78. In such an embodiment, the outer insulative coating 28 is attached to the inner diameter 24, the upper annular recess 78 and the lower annular recess 76 of each drill pipe 22. An upper and a lower conducting sleeve 82 and 80 are attached to the outer insulative coating 28 in the upper annular recess 78 and the lower annular recess 76, respectively. For instance, the upper and lower conducting sleeves 82 and 80 may be press fit into the upper and lower annular recesses 78 and 76, respectively.

In this embodiment, the conductive coating 30 is attached to the outer insulative coating 28 and to the upper and lower conducting sleeves 82 and 80 to establish an electrical pathway from the upper end 14 to the lower end 10 of each drill pipe 22. The inner insulative coating 32 is attached to the conductive coating 30 such that the conductive coating 30 is insulated.

As described above, to establish an electrical connection between the insulated electrically pathways of the adjacently connected drill pipes 22, the connector 36 is disposed between the lower end 10 of one drill pipe 22 and the upper end 14 of the adjacent drill pipe 22. When so positioned, the upper conducting contact 46 establishes an electrical connection 90 with the lower conducting sleeve 80 and the lower conducting contact 48 establishes an electrical connection 92 with the upper conducting sleeve 82, such that an insulated electrical pathway is established from the conductive coating 30 in the lower end 10 of one drill pipe 22, to the lower conducting sleeve 80, then to the upper conducting contact 46, then to the connector conducting material body portion 45, then to the lower conducting contact 48, then to the upper conducting sleeve 82, and then to the upper end 14 of the adjacent drill pipe 22.

The conducting sleeves 80 and 82 provide a more robust contact surface than the conductive coating. Hence the addition of the conducting sleeves 80 and 82 produces more secure electrical connection 90 and 92 with the connector 36. O-rings may be used, as described above, to prevent the drilling fluids from contaminating the electrical connections 90 and 92. In addition, rather than extending the outer insulative coating 28 into the upper and lower annular recesses 78 and 76, the contact sleeves 82 and 80 may each comprise an insulative material on its outer surface.

Figure 6:
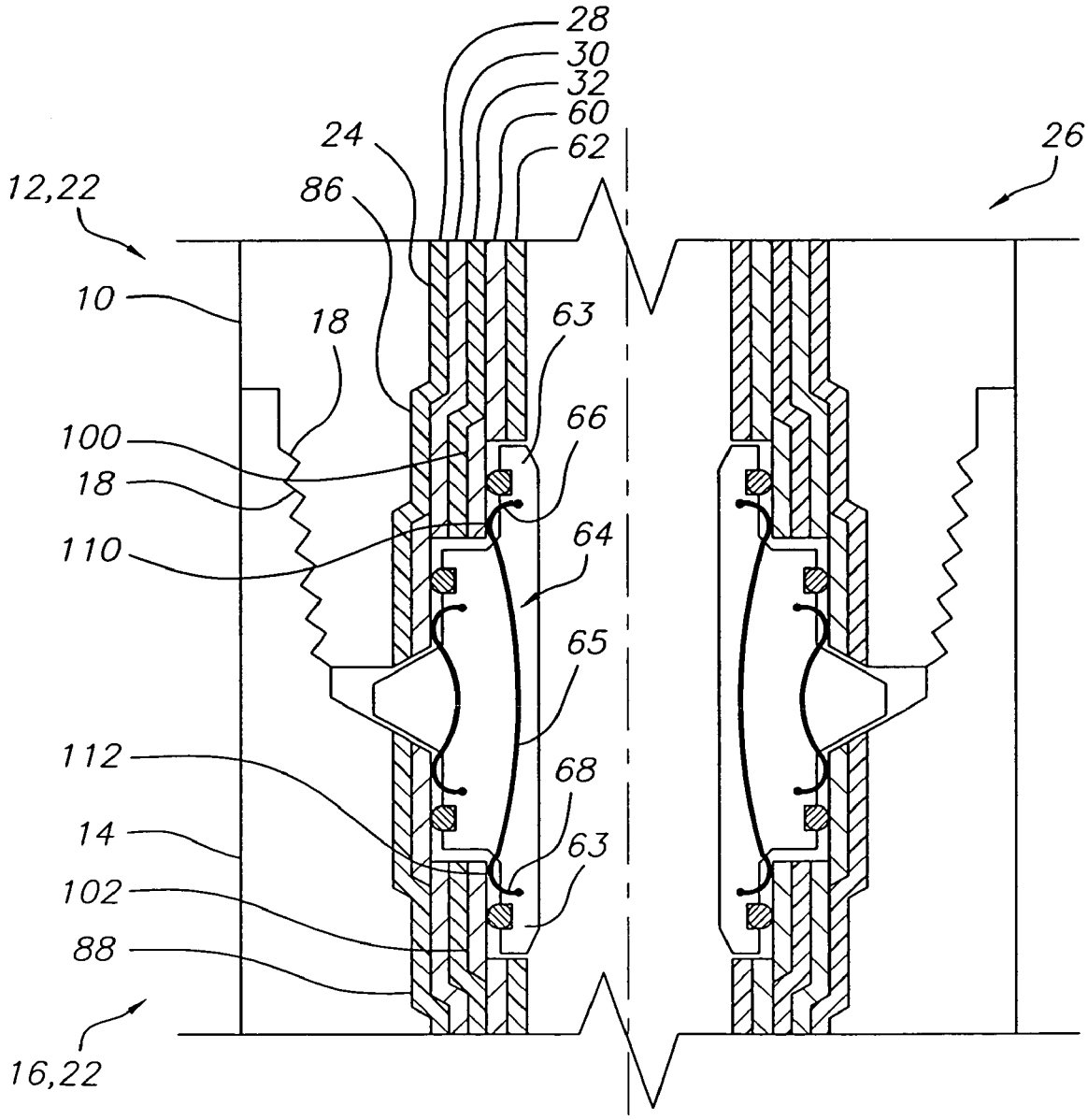
FIG. 6 is a cross-sectional view of the drill pipes of FIG. 1 threadingly connected, wherein each drill pipe has a first conductive coating electrically connected to a first upper and a first lower conductive sleeve and a second conductive coating electrically connected to a second upper and a second lower conductive sleeve, and wherein the first sleeve and the second sleeve are electrically connected by a connector.

In the embodiment depicted in FIG. 6, each drill pipe 22 in the drill string 26 comprises a second lower annular recess 86 and a second upper annular recess 88. In this embodiment, a second lower conducting sleeve 100 and a second upper conducting sleeve 102 are attached to the second lower annular recess 86 and the second upper annular recess 88, respectively, such as by press fitting. The second conductive coating 60 is attached to the inner insulative coating 32 and to the second upper and lower conducting sleeves 102 and 100 to establish a second electrical pathway from the upper end 14 to the lower end 10 of each drill pipe 22. The second inner insulative coating 62 is attached to the second conductive coating 60 such that the second conductive coating 60 is insulated.

In this embodiment, the connector 36 may comprise the inwardly stepped portion 63 comprising the second conducting material 64, such that the upper conducting contact 66 and a lower conducting contact 68 establish electrical contacts 110 and 112, respectively, with the second lower conducting sleeve 100 and the second upper conducting sleeve 112.

Each drill pipe 22 in the drill string 26 may comprise a plurality of conductive coatings and a plurality of corresponding upper and lower conducting sleeves; and each connector may comprise a corresponding plurality of inwardly stepped sections and conducting materials, such that the drill string 26 comprises a plurality of insulated electrical pathways from an upper end of the drill string 26 to a lower end of the drill string 26.

In each of the embodiments described above, each coating may have a thickness in the range of approximately 0.006 inches to approximately 0.030 inches. In addition, each insulative coating may comprise a plastic polymer such as an epoxy, phenolic, teflon, or nylon. The insulative coatings may be spray applied. The conductive coatings may comprise a metal material, such as copper, aluminum, silver or gold, or a mixture of metal particles and a polymer. The conductive coatings may be applied by plating or spraying.

The preceding description has been presented with references to presently preferred embodiments of the invention. Persons skilled in the art and technology to which this invention pertains will appreciate that alterations and changes in the described structures and methods of operation can be practiced without meaningfully departing from the principle, spirit and scope of this invention. Specifically, although drill strings having only one or two conductive pathways are described herein, it should be understood that the principles of the invention may be applied to form drill pipe and therefore drill strings having any arbitrary number of conductive pathways. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A drill pipe for an oil or gas well comprising:

a generally cylindrical hollow drill pipe having a length;

a conductive coating connected to the drill pipe to define an electrical pathway that extends along at least a portion of the length of the drill pipe; and a second conductive coating connected to the drill pipe to define a second electrical pathway that extends along at least a portion of the length of the drill pipe.

2. The drill pipe of claim 1, wherein the conductive coating is insulated.

3. The drill pipe of claim 1, wherein the conductive coating is surrounded by insulative coatings.

4. The drill pipe of claim 1, wherein the conductive coating extends from an upper end of the drill pipe to a lower end of the drill pipe.

5. The drill pipe of claim 1, wherein the conductive coating extends along the length of the drill pipe.

6. The drill pipe of claim 1, wherein the second conductive coating is applied over said conductive coating.

7. The drill pipe of claim 6, wherein the second conductive coating is insulated from said conductive coating.

8. The drill pipe of claim 1, further comprising a plurality of additional conductive coatings connected to the drill pipe to define a plurality of additional electrical pathways that each extend along at least a portion of the length of the drill pipe.

9. The drill pipe of claim 8, wherein each successive conductive coating in the plurality of conductive coatings is applied over an adjacent one of the plurality of conductive coatings.

10. The drill pipe of claim 9, wherein each conductive coating in the plurality of conductive coatings is insulated from said adjacent one of the plurality of conductive coatings.

11. A method of communicating to downhole oil or gas well equipment comprising:

providing a generally cylindrical hollow drill pipe having a length;

applying a conductive coating connected to the drill pipe to define an electrical pathway that extends along at least a portion of the length of the drill pipe; and further applying a second conductive coating on the drill pipe to define a second electrical pathway that extends along at least a portion of the length of the drill pipe.

12. The method of claim 11, further comprising insulating the conductive coating.

13. The method of claim 11, further comprising surrounding the conductive coating with insulative coatings.

14. The method of claim 11, wherein the conductive coating extends from an upper end of the drill pipe to a lower end of the drill pipe.

15. The method of claim 11, wherein the conductive coating extends along the length of the drill pipe.

16. The method of claim 11, wherein the second conductive coating is applied over said conductive coating.

17. The method of claim 16, further comprising insulating the second conductive coating from said conductive coating.

18. The method of claim 11, further comprising applying a plurality of additional conductive coatings on the drill pipe to define a plurality of additional electrical pathways that each extend along at least a portion of the length of the drill pipe.

19. The method of claim 18, wherein each successive conductive coating in the plurality of conductive coatings is applied over an adjacent one of the plurality of conductive coatings.

20. The method of claim 19, wherein each conductive coating in the plurality of conductive coatings is insulated from said adjacent one of the plurality of conductive coatings.

21. A drill pipe for an oil or gas well comprising:

a generally cylindrical hollow drill pipe having a length:

a conductive coating connected to the drill pipe to define an electrical pathway that extends along at least a portion of the length of the drill pipe; and wherein the conductive coating is connected to an inner diameter of the drill pipe.

22. The drill pipe of claim 21, wherein an insulative coating is connected to the inner diameter of the drill pipe between the inner diameter of drill pipe and the conductive coating, and wherein the insulative coating and the conductive coating each extend substantially along the length of the drill pipe.

23. A method of communicating to downhole oil or gas well equipment comprising:

providing a generally cylindrical hollow drill pipe having a length;

applying a conductive coating on the drill pipe to define an electrical pathway that extends along at least a porton of the length of the drill pipe wherein the conductive coating extends from an upper end of the drill pipe to a lower end of the drill pipe; and additionally applying an insulative coating to an inner diameter of the drill pipe and applying the conductive coating to the insulative coating such the insulative coating is disposed between the inner diameter of the drill pipe and the conductive coating, and wherein the insulative coating and the conductive coating each extend substantially along the length of the drill pipe.

* * * * *

UNITED STATES PATENT AND TRADEMARK OFFICE

CERTIFICATE OF CORRECTION

PATENT NO. : 7,117,944 B2
APPLICATION NO. : 10/812287
DATED : October 10, 2006
INVENTOR(S) : Boyadjieff It is certified that error appears in the above-identified patent and that said Letters Patent is hereby corrected as shown below:

| | |
|---|---|
| Column 4, line 48 | Delete "conductor",<br>Insert --connector-- |
| Column 5, line 21 | Delete " comprises",<br>Insert --comprise-- |
| Column 5, line 39 | Delete "electrically",<br>Insert --electrical-- |

In the Claims

| | |
|---|---|
| Column 7, line 24, Claim 11 | Delete "coating connected to",<br>Insert --coating on-- |
| Column 8, line 13, Claim 21 | Delete "length:",<br>Insert --length;-- |
| Column 8, line 31, Claim 23 | Delete "porton",<br>Insert --portion-- |

Signed and Sealed this

Seventh Day of August, 2007

JON W. DUDAS
*Director of the United States Patent and Trademark Office*